US011611174B2

(12) United States Patent
Lückemeier

(10) Patent No.: US 11,611,174 B2
(45) Date of Patent: Mar. 21, 2023

(54) ROUND PLUG HAVING LOCKING SYSTEM

(71) Applicant: HARTING Electronics GmbH, Espelkamp (DE)

(72) Inventor: Martin Lückemeier, Diepenau (DE)

(73) Assignee: HARTING Electronics GmbH, Espelkamp (DE)

( * ) Notice: Subject to any disclaimer, the term of this patent is extended or adjusted under 35 U.S.C. 154(b) by 138 days.

(21) Appl. No.: 17/291,875

(22) PCT Filed: Dec. 3, 2019

(86) PCT No.: PCT/DE2019/101034
§ 371 (c)(1),
(2) Date: May 6, 2021

(87) PCT Pub. No.: WO2020/119854
PCT Pub. Date: Jun. 18, 2020

(65) Prior Publication Data

US 2022/0013956 A1 Jan. 13, 2022

(30) Foreign Application Priority Data

Dec. 11, 2018 (DE) ..... 10 2018 131 720.4

(51) Int. Cl.
*H01R 13/622* (2006.01)
*H01R 13/627* (2006.01)
(Continued)

(52) U.S. Cl.
CPC ..... *H01R 13/6271* (2013.01); *H01R 13/40* (2013.01); *H01R 13/516* (2013.01); *H01R 13/622* (2013.01); *H01R 13/639* (2013.01)

(58) Field of Classification Search
CPC .. H01R 13/6271; H01R 13/40; H01R 13/516; H01R 13/622; H01R 13/639; H01R 13/6275
See application file for complete search history.

(56) References Cited

U.S. PATENT DOCUMENTS 4,919,627 A * 4/1990 Cable ..... H01R 39/64 439/372
4,941,846 A * 7/1990 Guimond ..... H01R 24/542 439/256
(Continued)

FOREIGN PATENT DOCUMENTS

CN 1538577 A 10/2004
CN 1788393 A 6/2006
(Continued)

*Primary Examiner* — Tho D Ta
(74) *Attorney, Agent, or Firm* — Smartpat PLC

(57) ABSTRACT

On a round plug, outwardly directed detent hooks are arranged between a plug-in region and a contact carrier portion of an insulating body or a base portion of the round plug housing. A mating connector has, on a plug-in side of a threaded portion, an inwardly directed circumferential or interrupted detent lug. The detent arms do not need to reach through the threaded portion. The detent arms can therefore be made particularly strong, and the inner thread can be continuous. The retaining forces of the locking/screwing are thus very high, and the detent arms for example can be integrally molded on a plastic insulation body, and thus be formed in one piece therewith, for simplified production. Operation and manufacture are significantly simplified.

22 Claims, 3 Drawing Sheets

(51) Int. Cl.

| | |
|---|---|
| ***H01R 13/40*** | (2006.01) |
| ***H01R 13/516*** | (2006.01) |
| ***H01R 13/639*** | (2006.01) |

(56) References Cited

U.S. PATENT DOCUMENTS

| | | | | |
|---|---|---|---|---|
| 6,267,612 | B1 * | 7/2001 | Arcykiewicz | H01R 13/6275 439/256 |
| 7,238,047 | B2 * | 7/2007 | Saettele | H01R 13/627 439/578 |
| 7,850,472 | B2 * | 12/2010 | Friedrich | H01R 13/6277 439/256 |
| 9,297,965 | B2 * | 3/2016 | Schmidt | H01R 13/6277 |
| 2004/0209509 | A1 | 10/2004 | Okamura et al. | |
| 2007/0042640 | A1 | 2/2007 | Rosenberger et al. | |
| 2009/0264003 | A1 * | 10/2009 | Hertzler | H01R 13/5219 439/607.41 |
| 2014/0235085 | A1 | 8/2014 | Su et al. | |
| 2015/0064957 | A1 | 3/2015 | Zhang et al. | |
| 2016/0190742 | A1 | 6/2016 | Jozwik et al. | |
| 2018/0183182 | A1 | 6/2018 | Fukumoto | |

FOREIGN PATENT DOCUMENTS

| | | | | |
|---|---|---|---|---|
| CN | 101656380 | A | 2/2010 | |
| CN | 203193047 | U | 9/2013 | |
| DE | 102015015202 | A1 | 5/2017 | |
| DE | 102016101506 | A1 * | 8/2017 | H01R 13/6271 |
| EP | 3343707 | A1 | 7/2018 | |
| WO | 2006120624 | A1 | 11/2006 | |
| WO | 2013148063 | A1 | 10/2013 | |

* cited by examiner

ROUND PLUG HAVING LOCKING SYSTEM

CROSS-REFERENCE TO RELATED APPLICATION

This application is a national stage application, filed under 35 U.S.C. § 371, of International Patent Application No. PCT/DE2019/101034, filed on Dec. 12, 2019, which claims the benefit of German Patent Application No. 10 2018 131 720.4, filed Dec. 11, 2018.

TECHNICAL FIELD

The disclosure relates to a round plug, a mating connector, and a system consisting of the round plug and the mating connector.

BACKGROUND

Round plugs and associated mating connectors are required in order to be plugged to one another for transmission of power and/or signal and to be screwed stably to one another and/or locked to one another in some other way in order to ensure the secure plug-in connection. It is clear to a person skilled in the art that even the mating connector, because of its screw connection capability and plug-in compatibility with said round plug, should likewise be included in the round plug category. However, here and below, it is referred to exclusively as a "mating connector" for better differentiation.

In the document DE 10 2015 015 202 B4, the prior art discloses a plug-in connector and a corresponding plug-in system with a segmented thread and a push-pull latching mechanism. It is disclosed here to design the thread in such a manner that at least one latching means of a complementary plug-in element can be inserted into at least one thread-free portion of the plug-in connector.

Numerous tests and simulations have revealed that the holding force of the thread in this design is insufficient for many applications. Furthermore, it is complicated to produce the grooves in the thread-free portions and correspondingly costly. In addition, in many cases undesirably high release forces occur during the release operation. Coding in relation to the mating connector is difficult, which results in the necessity of highly precise manufacturing and thus undesirably high costs.

SUMMARY

It is the object of the disclosure to improve the holding force of such a plug-in connector. This object is achieved by the features as claimed.

A round plug has an insulating body with a contact carrier portion and a hollow-cylindrical plug-in region. Radially movable latching arms are arranged on the outer side of the contact carrier portion, namely are attached thereto. In particular, the latching arms are held flexibly thereon.

The latching arms at their free-standing ends have radially outwardly directed latching hooks for latching in a mating connector. Adjoining said latching hooks, the latching arms have an outwardly directed engagement slope.

Furthermore, the round plug has a release sleeve which engages around the contact carrier portion. For interacting with said engagement slopes for the purpose of releasing the round plug from the mating connector, the release sleeve is held on the insulating body so as to be displaceable along the plug-in direction. In particular, said hollow-cylindrical plug-in region can be molded onto the contact carrier portion on the plug-in side.

The latching hooks are arranged on the insulating body in the vicinity of the transition from the plug-in region to the contact carrier portion.

The contact carrier portion of the round plug conventionally serves for holding plug-in contacts at their cable connection region. Its hollow-cylindrical plug-in region, into which the plug-in regions of the plug-in contacts conventionally project, serves for the plug-in-side connection to the mating connector.

A particularly great additional advantage is that the production can be simplified and the production costs reduced. Finally, it is highly complex in the prior art to insert the grooves into the thread-free regions of the internal thread of the mating connector such that the latching arms can be plugged through. According to the invention, there is no need to do this. In connection therewith, the coding in relation to the mating connector is furthermore also simplified, which advantageously enables simplified and therefore more cost-effective manufacturing.

A particular advantage of this round plug furthermore consists in that its latching pins are directed radially outward, i.e. away from one another. The housing of the mating connector can thus be designed as an installation housing and can be installed, for example, recessed in a side part of an electrical device. Such a recessed installation is customary in many applications and is sometimes also desired by customers for compatibility reasons. The latching pins of the round plug can therefore latch on the inner side of the mating connector housing at an encircling or interrupted, plug-in-side, inwardly directed latching lug thereof. The mating connector can thereby indeed have a continuous, i.e. non-segmented, internal thread which serves for increasing the stability and reliability of said screw connection. At the same time, however, the round connector can optionally also permit said "push-pull" latching. Since the latching hooks are arranged on the insulating body in the vicinity of the transition from the plug-in region to the contact carrier portion, they do not need to reach through the internal thread of the mating connector during the plug-in operation and can therefore advantageously be designed to be particularly short and/or particularly strong and, alternatively or in addition, can be present in particularly large numbers.

A further additional advantage is that a seal, for example a sealing ring, in particular an O ring, or a molded-on molded seal, despite said combined screwing and latching connection according to the generic type, can act in a radially sealing manner, i.e. is radially compressed in the plug-in operation instead of having to be compressed in the plug-in direction—as known in the prior art, and therefore the plug-in system can provide a particularly good seal.

In particular, only one seal, for example only one sealing ring, is therefore necessary, which constitutes a considerable structural advantage over the prior art for this generic type. The seal can be arranged on the round connector, in particular on the plug-in region thereof, preferably at the contact-carrier-portion end of the hollow-cylindrical plug-in region. At this location, the insulating body can preferably have a groove for fastening the sealing ring.

A further advantage consists in that, because of the high holding force of this design, the material, in an advantageous configuration, can be somewhat less hard/stable, which has a positive effect on the manufacturing technology, the tolerances and therefore also on the production cost.

The latching arms can be formed integrally together with the insulating body and molded onto the outer side of the contact carrier portion. This permits simple mechanical production by injection molding. In particular, the insulating body can be formed from plastic. The elasticity of the latching arms in addition to their shape can then also be set via the composition of the plastic.

In a preferred refinement, the insulating body can therefore be completely or else only partially composed of an elastic plastic, namely at least in a connecting portion in which the latching arms are attached to the contact carrier portion. As a result, it can particularly advantageously ensure the necessary movable connection, namely in this case elastic connection, between the latching arms and the contact carrier portion. This refinement advantageously permits automated manufacturing with only a little outlay and furthermore follows a philosophy which predetermines manufacturing the plug-in connector as substantially as possible from plastic/plastics parts, which, inter alia, serves to simplify the automated production processes and the cost saving.

For this purpose, the elastic plastic can be a thermoplastic or a thermosetting plastic or an elastomer.

The internal thread of the mating connector is formed continuously, i.e. is not segmented, and thus has a comparatively high holding force. The latching arms can be comparatively short and therefore strong since they form an only short lever. Furthermore, the number thereof is not restricted by them having to engage in a predetermined number of thread-free regions of the mating connector, the number by definition conventionally being limited to a maximum of three or four.

Alternatively, however, the latching arms can also be part of a separate latching device. Their elasticity can then be readily set separately from that of the insulating body by means of their material and/or their shape. For example, they can be formed from sheet metal, in particular from spring-elastic sheet metal, for example stainless steel sheet. This has the advantage of a dual function since they can then simultaneously also have a shielding function. In particular, they can be designed as a punched and bent part, which permits ergonomic production.

As already mentioned, the round plug can have a radially acting seal.

The plug-in region can have, at its contact-carrier-portion end, an encircling groove for securing the seal on the insulating body.

The seal can be an O-shaped sealing ring or a molded seal molded onto the insulating body.

The mating connector has a mating connector housing with a threaded portion having an internal thread. An encircling or interrupted latching lug is molded onto the inner side of the mating plug housing. Said latching lug is molded onto the mating connector housing on the plug-in side of the internal thread. In particular, the latching lug is arranged at the plug-in-side end of the mating connector housing.

In the plugged-in state, the plug-in region of the round plug can thus enter the threaded portion of the mating connector while at the same time the latching hooks of the round connector latch to the plug-in-side latching lug of the mating connector.

In an alternative refinement, an alternative round plug has a round plug housing with a base portion, to the outer side of which a separate latching device engaging around the base portion is attached. Said latching device has radially movable latching arms, wherein the latching arms, at their free-standing ends, have radially outwardly directed latching hooks for latching in a mating connector. Adjoining the latching hooks, said latching arms have an outwardly directed engagement slope.

Furthermore, the alternative round plug has said, or an alternative but identically acting, release sleeve which engages around the contact carrier portion. For the interaction with said engagement slopes of the latching arm in order to release the alternative round plug from the mating connector, the release sleeve is held on the round plug housing so as to be displaceable along the plug-in direction. In addition, the round plug housing has a hollow-cylindrical housing plug-in region which is molded onto the base portion on the plug-in side.

The latching hooks in this design are arranged on the round plug housing in the vicinity of the transition from the housing plug-in region to the base portion.

The separate latching device can be formed from a spring-elastic material, in particular spring-elastic sheet metal, for example stainless steel sheet. In particular, it can be a punched and bent part.

The round plug housing can be manufactured from a particularly hard material, for example from a zinc alloy by zinc diecasting.

The alternative round plug can have a radially acting seal.

The housing plug-in region can have, at its contact-carrier-portion end, an encircling groove for securing the seal.

The seal can be an O-shaped sealing ring ("O ring").

The abovementioned advantages of the round plug furthermore also apply to the alternative round plug.

In the plugged-in state, the housing plug-in region of the alternative round plug can enter the threaded portion of the mating connector while at the same time the latching hooks of the alternative round plug latch to the plug-in-side latching lug of the mating connector. The latching arms therefore do not need to reach through the internal thread and can be designed to be stronger, and the internal thread does not need to be segmented. The locking forces and the holding forces of the screw connection are thereby improved.

BRIEF DESCRIPTION OF THE DRAWINGS

An exemplary embodiment of the invention is illustrated in the drawings and will be explained in more detail below.

DETAILED DESCRIPTION

The figures contain partially simplified schematic illustrations. To some extent, identical reference signs are used for identical elements, but optionally elements which are not identical. Different views of identical elements may differ in scale.

Figure 1A:
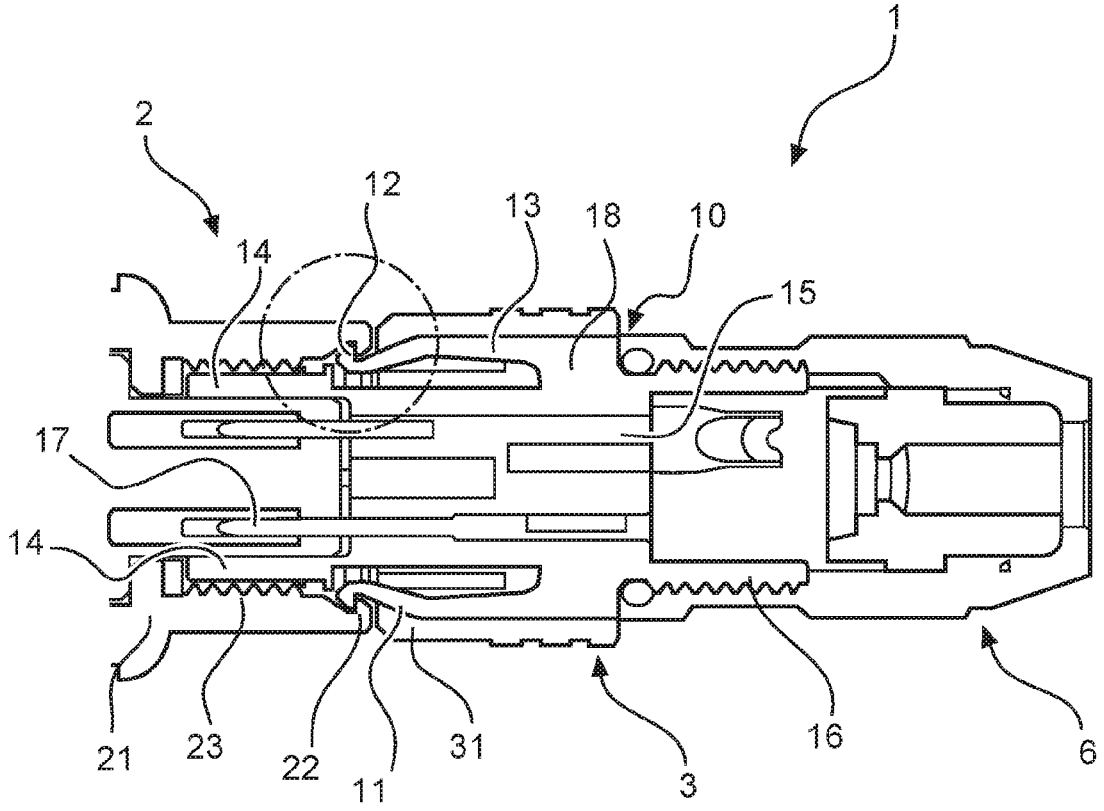
FIG. 1*a* shows a cross section of a round plug plugged to a mating connector.
Figure 1B:
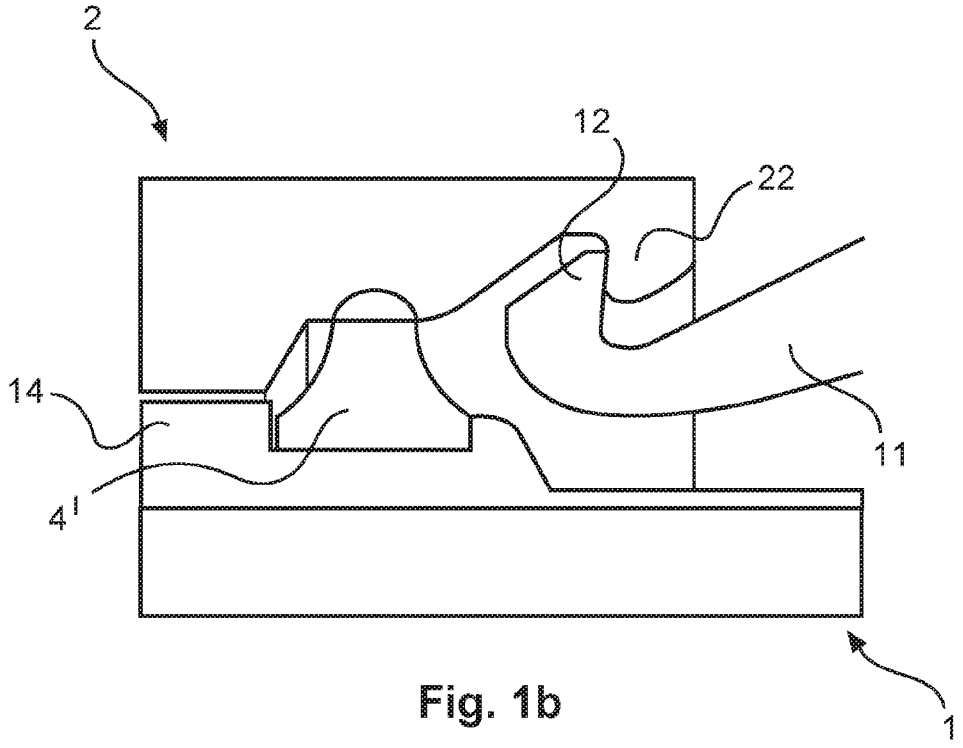
FIG. 1*b* shows an enlargement of a latching from the previous illustration.

FIGS. 1*a* and 1*b* show a system consisting of a round plug 1 and a mating connector 2 in cross section. The round plug 1 is plugged to the mating connector 2 and latched thereto. FIG. 1*b* shows an enlargement of the circled detail in FIG. 1*a*.

The round plug 1 has, illustrated on the right in the drawing, a cable screw connection 6 which is screwed to a cable screw-connection thread 16 of an insulating body 100 of the round plug 1 for the insertion, securing and sealing of an inserted cable.

Said cable screw-connection thread 16 is adjoined by the contact carrier portion 10. The latter has passage openings 15 for receiving plug-in contacts 17, of which one is illustrated by way of example continuously in the drawing and the other is only partially illustrated, so as to free up the view of the contact carrier opening 15. The plug-in contacts 17 thus held in the contact carrier portion 10 project on the plug-in side into a hollow-cylindrical plug-in region 14 which is likewise part of the insulating body and adjoins the contact carrier portion 10.

A plurality of latching arms 13 are integrally formed on the outer side of the contact carrier portion 10. Said latching arms 13 are held on the insulating body 100 in a radially movable, namely elastically deformable, manner. For the two latching arms 13 illustrated here, this means that they can be deflected in relation to the contact carrier portion 10 movably, namely elastically, up and down in the drawing, i.e. under the application of a restoring force corresponding to their deflection. In the present embodiment, the latching arms 13 are formed integrally, for example injection molded, with the insulating body 100, namely are molded onto the contact carrier portion 10 thereof via a connecting portion 18, with the entire insulating body 100 being composed of plastic. In order to ensure the radial movability of the latching arms 13, it would basically be sufficient if said connecting portion 18 were composed of an elastic plastic, for example of a thermoplastic. However, in the present exemplary embodiment, the entire insulating body 100 is composed of a standard material, namely a thermoplastic, in order to permit production in a simple injection molding process. Furthermore, in this embodiment, four latching arms 13 are provided, but it is, of course, clear to a person skilled in the art that any other number is also conceivable.

The latching arms 13 have, at their free-standing ends, radially outwardly directed latching hooks 12 for locking to the mating connector 2. Adjoining said latching hooks, they each have an outwardly directed engagement slope 12, the function of which is explained by the interaction with a release sleeve 3 engaging around the contact carrier portion 10, more precisely the release slopes 31 of said release sleeve.

If the release sleeve 3 is namely pulled manually in the release direction, i.e. away from the mating connector, thus from left to right in the drawing, the release slopes 31 thereof press the two latching arms 13 inward at their engagement slopes 11, i.e. toward each other in the drawing. In particular, the latching arms 13 because of their elasticity and the associated restoring force can also thereby move the release sleeve 3 again into its locking position, i.e. toward the mating connector 2.

By means of said manual pulling of the release sleeve in its release direction, the latching hooks 12, which can be seen particularly readily in FIG. 1*b*, unlatch from an encircling latching lug 22 of the mating connector 2, said latching lug being molded onto the mating connector 2, namely onto its mating connector housing 21, on the plug-in side and in a manner directed inward. The latching hooks 12 project here into the substantially cylindrical plug-in opening of the mating connector 2, said plug-in opening not being denoted specifically for clarity reasons.

Furthermore, the seal in this illustration is designed as a molded seal 4' which is molded onto the plug-in region 14.

In the region of said plug-in opening, the mating connector housing 21 has a threaded portion 23 with a continuous, i.e. non-segmented, internal thread. The encircling latching lug 22 is arranged on the plug-in side (on the right in the drawing) of the threaded portion 23. The latching hooks 12 of the plug-in connector 1 are arranged on the insulating body 100 in the vicinity of the transition from the plug-in region 14 to the contact carrier portion 10. In the plugged-in state, the plug-in region 14 of the round plug 1 enters the threaded portion 23 of the mating connector 2 while at the same time the latching hooks 12 of the round connector 1 latch to the plug-in-side latching lug 22 of the mating connector 2.

Figure 1C:
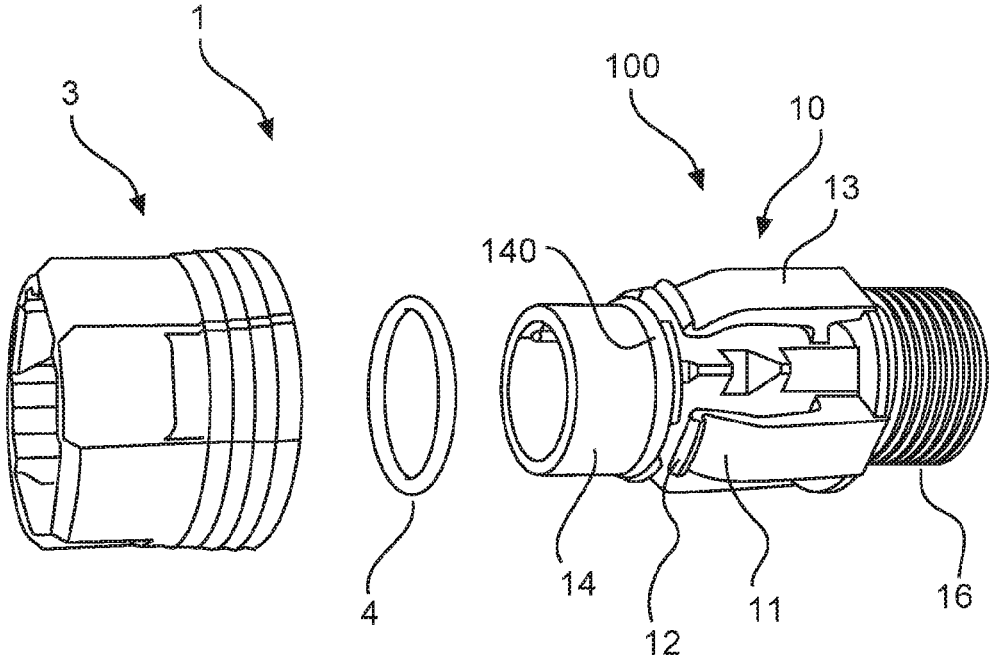
FIG. 1*c* shows the round plug in an exploded illustration.

FIG. 1*c* shows the round plug in an exploded illustration. It can readily be seen that the plug-in region 14 has a hollow-cylindrical shape and, on the contact-carrier side, has a groove 140 for securing the sealing ring 4. Furthermore, it is readily conceivable for the round plug 100 to have four latching arms 13, although only three can be seen in the drawing, because the fourth is concealed by the insulating body 100.

The substantially hollow-cylindrical basic shape of the release sleeve 3 can likewise be readily seen.

In this illustration, the seal is designed as a sealing ring 4. It is secured in a groove 140 which is arranged on the plug-in region 14 on the contact-carrier-portion side.

Figure 1D:
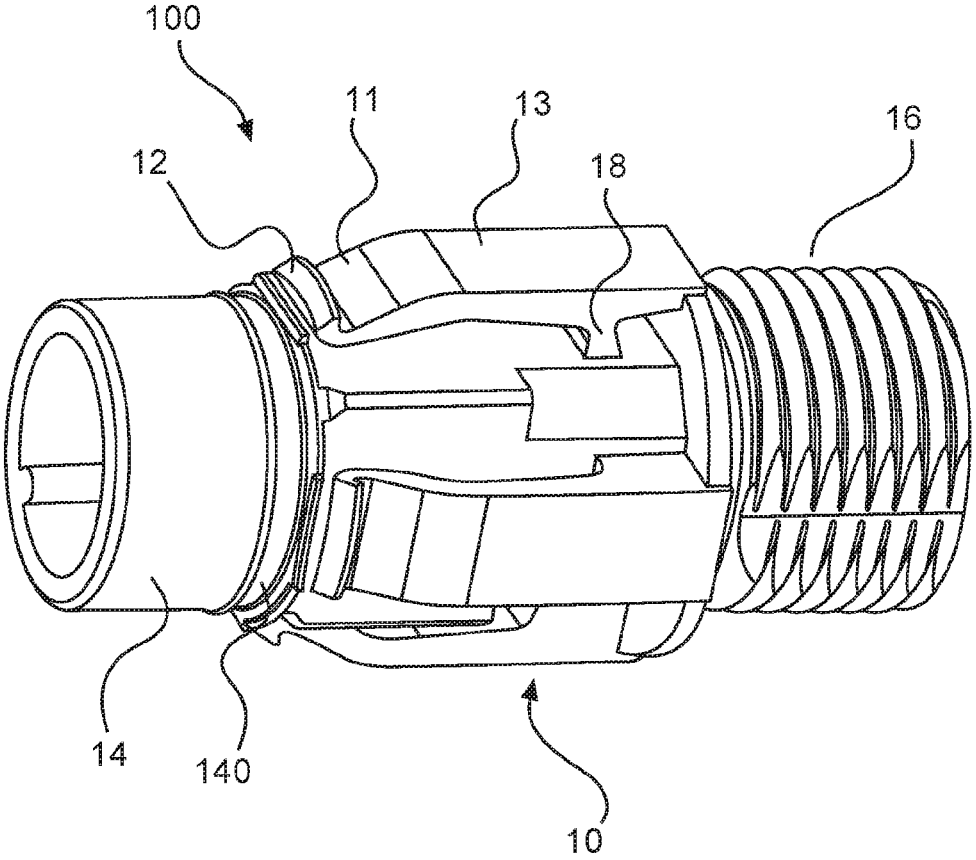
FIG. 1*d* shows an insulating body of the round plug.

FIG. 1*d* shows the insulating body 100 in enlarged form likewise in a 3D view. A latching arm 13 with its latching hook 12 and its engagement slopes 11 are provided with reference signs here as representatives of the other ones. The radially outwardly directed latching hooks 12 are arranged on the insulating body 100 in the vicinity of the transition from the plug-in region 14 to the contact carrier portion 10.

Figure 2A:
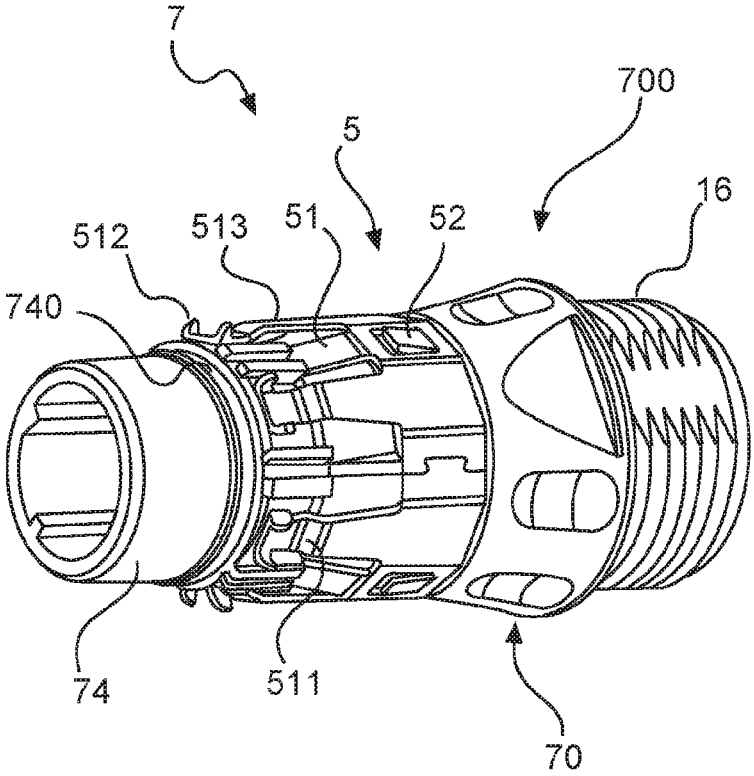
FIG. 2*a* shows an alternative insulating body of the round plug with a separate latching device.

FIG. 2*a* shows another embodiment. An alternative round plug has a round plug housing 700 which is composed of a comparatively hard material, for example zinc diecasting. A separate contact carrier (not shown) for receiving and for holding the plug-in contacts 17 is fitted into the round plug housing 700.

The round plug housing 700 has a base portion 70 to which a separate latching device 5 is attached. The separate latching device engages around the base portion 70 and is fixed thereto by first holding tabs 51 and second holding tabs 52. The separate latching device has latching arms 513 with latching pins and engagement slopes 512 which, analogously to the above-described latching arms 13, interact with said release sleeve 3 or with a release sleeve which is not shown and which is particularly well coordinated with said design.

Furthermore, the round plug housing 700 has a housing plug-in region 74 with a housing groove 740, which is arranged thereon adjacent to the base portion 70, i.e. on the base-portion side, for receiving the seal in the form of a sealing ring 4.

Figure 2B:
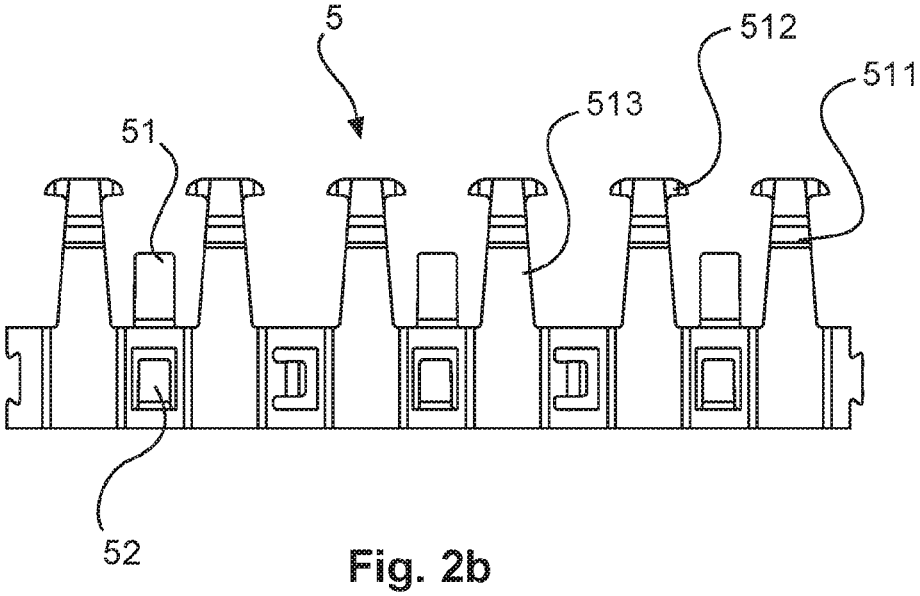
FIG. 2*b* shows the separate latching device in the punched-out, but unbent state.

The elastic latching arms 513 are therefore part of the separate latching device. In a further embodiment in FIG. 2*b*, said latching device is designed separately as a punched and bent part. It can easily be seen that said latching device can be punched out of spring-elastic sheet metal, placed around the base region, secured thereto by its holding tabs 51, 52 and closed with its dovetail connection, not denoted specifically.

In said composite design, the plug housing 700 can be particularly hard and stable. At the same time, the necessary elasticity of the latching arms 513 is determined by the material of the separate latching device, e.g. spring sheet metal.

Even though various aspects or features of the invention are respectively shown in combination in the figures, it is clear to a person skilled in the art that—unless otherwise stated—the combinations shown and discussed are not the only ones possible. In particular, mutually corresponding units or complexes of features from different exemplary embodiments can be exchanged with one another. In particular, it is conceivable for an insulating body which is not illustrated in the drawing and is composed of plastic to be provided with said separate latching device 5.

LIST OF REFERENCE SIGNS

1 Round plug
10 Contact carrier portion
100 Insulating body
11 Latching hook
12 Engagement slope
13 Latching arm
14 Plug-in region
140 Groove
15 Passage openings
16 Cable screw-connection thread
17 Plug-in contacts
18 Connecting portion
2 Mating connector
21 Mating connector housing
22 Latching lug
23 Threaded portion
3 Release sleeve
31 Release slope
4, 4' Seal (O-shaped sealing ring/molded-on molded seal)
5 Separate latching device
511 Latching hook
512 Engagement slope
513 Latching arm
514 Plug-in region
51, 52 First, second holding tabs
6 Cable screw connection
7 Alternative round plug
700 Round plug housing
70 Base portion
74 Housing plug-in region
740 Housing groove

The invention claimed is:

1. A round plug (1), comprising:
an insulating body (100) with
a contact carrier portion (10) and
a hollow-cylindrical plug-in region (14),
wherein radially movable latching arms (13, 513) are attached to an outer side of the contact carrier portion (10) and point with free-standing ends in the direction of the plug-in region (14),
wherein the latching arms (13, 513) at their free-standing ends have radially outwardly directed latching hooks (12, 512) for latching in an inner portion of a mating connector (2) and, adjoining said latching hooks, have an outer engagement slope (11, 511); and
a release sleeve (3) which engages around the contact carrier portion (10) and, for interaction with said engagement slopes (11, 511) in order to release the round plug (1) from the mating connector (2), is held on the insulating body (100) so as to be displaceable along a plug-in direction,
wherein the latching hooks (12, 512) are arranged on the insulating body (100) in a vicinity of a transition from the plug-in region (14) to the contact carrier portion (10).

2. The round plug (1) as claimed in claim 1,
wherein the insulating body (100) is made entirely of plastic.

3. The round plug as claimed in claim 1,
wherein the latching arms (13) are held on the insulating body (100) in an elastically resilient manner.

4. A mating connector (2), comprising:
a mating connector housing (21) with
a threaded portion (23) having an internal thread, and
an encircling or interrupted, inwardly directed latching lug (22), which is molded onto the mating connector housing (24) on a plug-in side of the threaded portion (23), for latching to the latching arms (13, 513) of the round plug (1) as claimed in claim 1.

5. A system consisting of the round plug (1) as claimed in claim 1 and a mating connector (2) comprising
a mating connector housing (21) with
a threaded portion (23) having an internal thread, and
an encircling or interrupted, inwardly directed latching lug (22), which is molded onto the mating connector housing (24) on a plug-in side of the threaded portion (23), for latching to the latching arms (13, 513) of the round plug (1),
wherein, in a plugged-in state, the plug-in region (10) of the round plug (1) enters the threaded portion (23) of the mating connector (2) while at the same time the latching hooks (12) of the round connector (1) latch to the plug-in-side latching lug (22) of the mating connector (2).

6. The round plug (1) as claimed in claim 1,
wherein the latching arms (13) are formed integrally together with the insulating body (100) and are molded onto the outer side of the contact carrier portion (10).

7. The round plug (1) as claimed in claim 6,
wherein the insulating body (100) is at least partially composed of an elastic plastic, namely at least in a connecting portion (18) with which the latching arms (13) are molded on the contact carrier portion (10), in order to ensure a movable connection between the latching arms (13) and the contact carrier portion (10).

8. The round plug (1) as claimed in claim 7,
wherein said elastic plastic is a thermoplastic or a thermosetting plastic or an elastomer.

9. The round plug (1) as claimed in claim 1,
wherein the latching arms (513) are part of a separate latching device (5) which is fastened to the contact carrier portion (10).

10. The round plug (1) as claimed in claim 9,
wherein the separate latching device (5) is formed from elastic sheet metal.

11. The round plug (1) as claimed in claim 10,
wherein the separate latching device (5) is a punched and bent part.

12. The round plug (1) as claimed in claim 1,
wherein the round plug (1) has a radially acting seal (4, 4').

13. The round plug (1) as claimed in claim 12,
wherein the plug-in region (14) has, at its contact-carrier-portion end, an encircling groove (140) for securing the seal (4).

14. The round plug (1) as claimed in claim 12, wherein the seal is an O-shaped sealing ring (4).

15. The round plug (1) as claimed in claim 12, wherein the seal is a molded-on molded seal (4').

16. A round plug (7), comprising:

a round plug housing (700) with a base portion (70), to an outer side of which a separate latching device (5) which engages around the base portion (70) and has radially movable latching arms (513) is attached, wherein the latching arms (513) at their free-standing ends have radially outwardly directed latching hooks (512) for latching in an inner portion of a mating connector (2), and, adjoining said latching hooks, have an outwardly directed engagement slope (511), wherein the round plug (7) furthermore has a release sleeve (3) which engages around a contact carrier portion (10) and, for interaction with said engagement slopes (511) in order to release the round plug (7) from the mating connector (2), is held on the round plug housing (700) so as to be displaceable along a plug-in direction, wherein the round plug housing (700) has a hollow-cylindrical housing plug-in region (74) molded onto the base portion (70) on a plug-in side, wherein the latching hooks (512) are arranged on the round plug housing (700) in a vicinity of a transition from the housing plug-in region (74) to the base portion (70).

17. A system consisting of the round plug (7) as claimed in claim 16 and a mating connector (2) comprising a mating connector housing (21) with a threaded portion (23) having an internal thread, and an encircling or interrupted, inwardly directed latching lug (22), which is molded onto the mating connector housing (24) on a plug-in side of the threaded portion (23), for latching to the latching arms (13, 513) of the round plug (7), wherein, in a plugged-in state, the housing plug-in region (70) of the round plug (7) enters the threaded portion (23) of the mating connector (2) while at the same time the latching hooks (512) of the round plug (7) latch to the plug-in-side latching lug (22) of the mating connector (2).

18. The round plug (7) as claimed in claim 16, wherein the separate latching device (5) is formed from sheet metal.

19. The round plug (7) as claimed in claim 18, wherein the separate latching device (5) is a punched and bent part.

20. The round plug (7) as claimed in claim 16, further comprising a radially acting seal (4).

21. The round plug (7) as claimed in claim 20, wherein the housing plug-in region (74) has, at its contact-carrier-portion end, an encircling groove (740) for securing the seal (4).

22. The round plug (7) as claimed in claim 20, wherein the seal is an O-shaped sealing ring (4) ("O ring").

* * * * *